US007086567B1

(12) United States Patent
Ciavarella et al.

(10) Patent No.: US 7,086,567 B1
(45) Date of Patent: Aug. 8, 2006

(54) WALL-MOUNTED DISPENSER ASSEMBLY WITH TRANSPARENT WINDOW

(75) Inventors: Nick E. Ciavarella, Seven Hills, OH (US); David Hayes, Wooster, OH (US); John P. Cichello, II, Wooster, OH (US)

(73) Assignee: Joseph S. Kanfer, Richfield, OH (US)

( * ) Notice: Subject to any disclaimer, the term of this patent is extended or adjusted under 35 U.S.C. 154(b) by 640 days.

(21) Appl. No.: 10/202,059

(22) Filed: Jul. 25, 2002

(51) Int. Cl.
*B65D 35/28* (2006.01)

(52) U.S. Cl. ..... 222/95; 222/105; 222/153.03; 222/156; 222/181.3

(58) Field of Classification Search ..... 222/95, 222/105, 153.01, 156, 181.1–181.3, 153.03
See application file for complete search history.

(56) References Cited

U.S. PATENT DOCUMENTS

| | | | | | |
|---|---|---|---|---|---|
| 4,238,056 | A | * | 12/1980 | Tucker et al. | 222/181.2 |
| 4,621,749 | A | | 11/1986 | Kanfer | 222/153 |
| 5,265,772 | A | | 11/1993 | Bartasevich | 222/214 |
| 5,370,267 | A | | 12/1994 | Schroeder | 222/1 |
| 5,443,236 | A | | 8/1995 | Bell et al. | 248/311.3 |
| 5,464,125 | A | * | 11/1995 | Daansen | 222/156 |
| 5,465,877 | A | | 11/1995 | Bell et al. | 222/181.2 |
| 5,625,659 | A | | 4/1997 | Sears | 377/21 |
| 5,713,492 | A | * | 2/1998 | DeGennaro | 222/153.03 |
| 5,944,227 | A | | 8/1999 | Schroeder et al. | 222/144.5 |
| 6,082,586 | A | * | 7/2000 | Banks | 222/95 |
| 6,131,773 | A | * | 10/2000 | Wade et al. | 222/153.02 |
| D433,938 | S | | 11/2000 | Polan | D9/417 |
| 6,158,620 | A | | 12/2000 | Polan | 222/92 |
| 6,216,916 | B1 | | 4/2001 | Maddox et al. | 222/105 |
| 6,223,947 | B1 | * | 5/2001 | Bernard | 222/113 |
| 6,390,329 | B1 | | 5/2002 | Maddox | 222/25 |

* cited by examiner

*Primary Examiner*—Joseph A. Kaufman
(74) *Attorney, Agent, or Firm*—Renner, Kenner, Greive, Bobak, Taylor & Weber

(57) ABSTRACT

A dispenser for releasably receiving a collapsible bottle having a neck and a pump projecting from the neck. The dispenser includes a back plate with a cover hinged thereto and a container receiving bracket carried on the back plate for receiving the neck of the bottle. The bottle may include a security collar fixed to the neck with a rib geometry on its periphery for mating with a complemental geometry on the bracket to fix the bottle in place on the back plate. The cover carries a projecting transverse rib on its inner surface so that, when the cover is closed, the rib engages the security collar to further assist in retaining and locating the bottle. The cover also includes a transparent sight window located adjacent its lower end for observing the level of the contents of the bottle, a light window adjacent its upper end for admitting ambient light into the closed dispenser and a push bar for activating the pump to dispense material from the bottle.

9 Claims, 11 Drawing Sheets

WALL-MOUNTED DISPENSER ASSEMBLY WITH TRANSPARENT WINDOW

RELATED PATENT APPLICATIONS

None.

FIELD OF THE INVENTION

This invention relates, in general, to dispenser assemblies for dispensing fluid products and relates, in particular, to an improved dispenser assembly for use with a collapsible bottle structure for insuring the bottle is accurately placed and retained within the dispenser, which has improved viewing means for effectively indicating the level of the bottle contents, and keying means for insuring that only the proper bottle can be received in the proper dispenser.

BACKGROUND OF THE INVENTION

There are a number of fluid dispensing combinations known in the prior art generally including a back plate or body and a cover hingedly or otherwise secured to the body so that it can be opened and closed with respect thereto and a refill cartridge or container, often taking the form of a collapsible bottle for refilling the dispenser assembly when the contents of the original or current container or refill cartridge has been exhausted.

Examples of various dispensers of this general type can be seen in the following patents: Kanfer U.S. Pat. No. 4,621,749; Bartasevich U.S. Pat. No. 5,265,772; Schroeder U.S. Pat. No. 5,370,267; Bell U.S. Pat. No. 5,443,236; Bell U.S. Pat. No. 5,465,877; Sears U.S. Pat. No. 5,625,659; Schroeder U.S. Pat. No. 5,944,227; Maddox U.S. Pat. No. 6,216,916; and Maddox U.S. Pat. No. 6,390,329.

Many of these dispensers utilize a collapsible bag containing the fluid with a box supporting the bag and with the pump attached to the bag so that the box and pump can be readily utilized to replace exhausted containers. Many others, however, also use a collapsible container or refill taking the form of a molded collapsible bottle such as can be seen in Banks U.S. Pat. No. 5,445,288 rather than a collapsible bag.

In general, the marketplace, particularly for skin care products, is interested in products that are packaged in sanitary and sealed containers to ensure that the products do not become contaminated during their life cycle in the dispenser. Also there is a desire to provide problem-free dispensers. To that end, a sanitary, sealed system wherein the refill cartridge or container is non-vented to the environment provides the highest degree of product quality to the end user. In such systems germs or other foreign matter cannot enter the container or cartridge to contaminate the contents once the container is filled.

To that end, as noted, collapsible bottles are gaining in popularity. These are soft or thin walled molded bottles which collapse completely similarly to the collapsible bag of the prior art, but are felt to have less of a tendency to leak because there are no seams or welds which can open and leak. Bottles are generally also easier to handle than bags and can be shipped without individual protective packaging such as the box described above.

A major problem encountered with collapsible bottles, however, is the inability to control the collapse geometry. In most cases, these bottles have fold lines in them which are designed to more or less control the collapse so that no jamming or dislocation of the bottle within the dispenser occurs as the contents are exhausted and the bottle collapses.

When such collapse happens though, even with the most elaborate fold line construction, the bottle will still tend to twist to one side or the other and cause the dispenser to malfunction unless such movement can be controlled. Otherwise, this can cause the pump and discharge nozzle to become misaligned and the dispenser to malfunction.

It is also the case with dispensers and refill cartridges or containers of this type that the dispensers are maintained by janitorial staff and it is desirable to check the actual product level of the container or bottle within the dispenser to ascertain whether replacement is called for at the present time or in the near future. It is desirable to avoid having to open the dispenser to conduct this inspection and, to that end, the prior art has utilized what are called sight windows which are clear transparent areas of the cover so that one can observe the level of material without opening the cover. However, the prior art sight windows have also proved to be somewhat less than fully trustworthy especially because the window is usually relatively small and also due to the fact that the dispenser assembly is closed during operation and its interior is essentially light-free at that time except for any light which might enter through the sight window, there is some difficulty in observing the contents.

Furthermore, the sight windows are generally located adjacent the lower end of the cover and really are only effective to disclose the actual product level when the contents are nearly exhausted or when the janitor has to actually open the dispenser to see the actual level of the product.

Furthermore, there is a problem with dispensers of this type which are frequently used in the healthcare field, for example, in that it is often the case that the cover is labeled or bears some indicia which indicates the type of material contained therein, e.g., soap, lotion, antibacterial solution, etc. In the prior art, these products are packaged in bags or bottles of a uniform nature and, therefore, while a given installation or customer may have a variety of such products in inventory, a problem is often encountered in that the product which is actually placed into the dispenser is not the one indicated on the outer surface of the cover and, therefore, the user receives something different from want he or she might have expected or desired. Therefore, it is felt to be desirable to provide some sort of keying arrangement wherein the dispenser will only accept the proper type of refill.

Accordingly the principal objects of this invention are to provide a dispenser which firmly and accurately retains the proper bottle or refill cartridge during use, one in which the contents are readily viewable from the exterior thereof and one in which refilling with the proper material is insured.

SUMMARY OF THE INVENTION

In furtherance of the above-identified objects of the invention it has been found that viewing of the contents of the container can be enhanced by the provision of the usual sight window located adjacent the lower end of the cover and intended to permit one to view the refill container to ascertain whether its contents are exhausted or nearly exhausted by adding a light window much greater size adjacent the top end of the cover so as to permit greater ambient light to be received interiorly thereof.

Further, it has been discovered that the security of the refill container, which is normally collapsible plastic bottle, can be achieved by providing a container receiving bracket on the back plate and a mating collar on the container so that the container, once inserted into the dispenser, is fixedly held in place to avoid displacement or dislocation of the pump.

It has further been found that the problem of refilling with the wrong product can be overcome by providing a collar on the replaceable container or refill element, said collar having a particular geometry of ribs on its exterior periphery and the dispenser receiving bracket therein having a mating groove or slot configuration complemental to that of the collar on the container so that only the proper container can be inserted into a given dispenser.

It accordingly becomes the principal object of this invention to provide an improved dispenser assembly of the character above described with further objects thereof becoming more apparent upon a reading of the following brief specification considered and interpreted in view of the accompanying drawings.

BRIEF DESCRIPTION OF THE PREFERRED EMBODIMENTS

Figure 1:
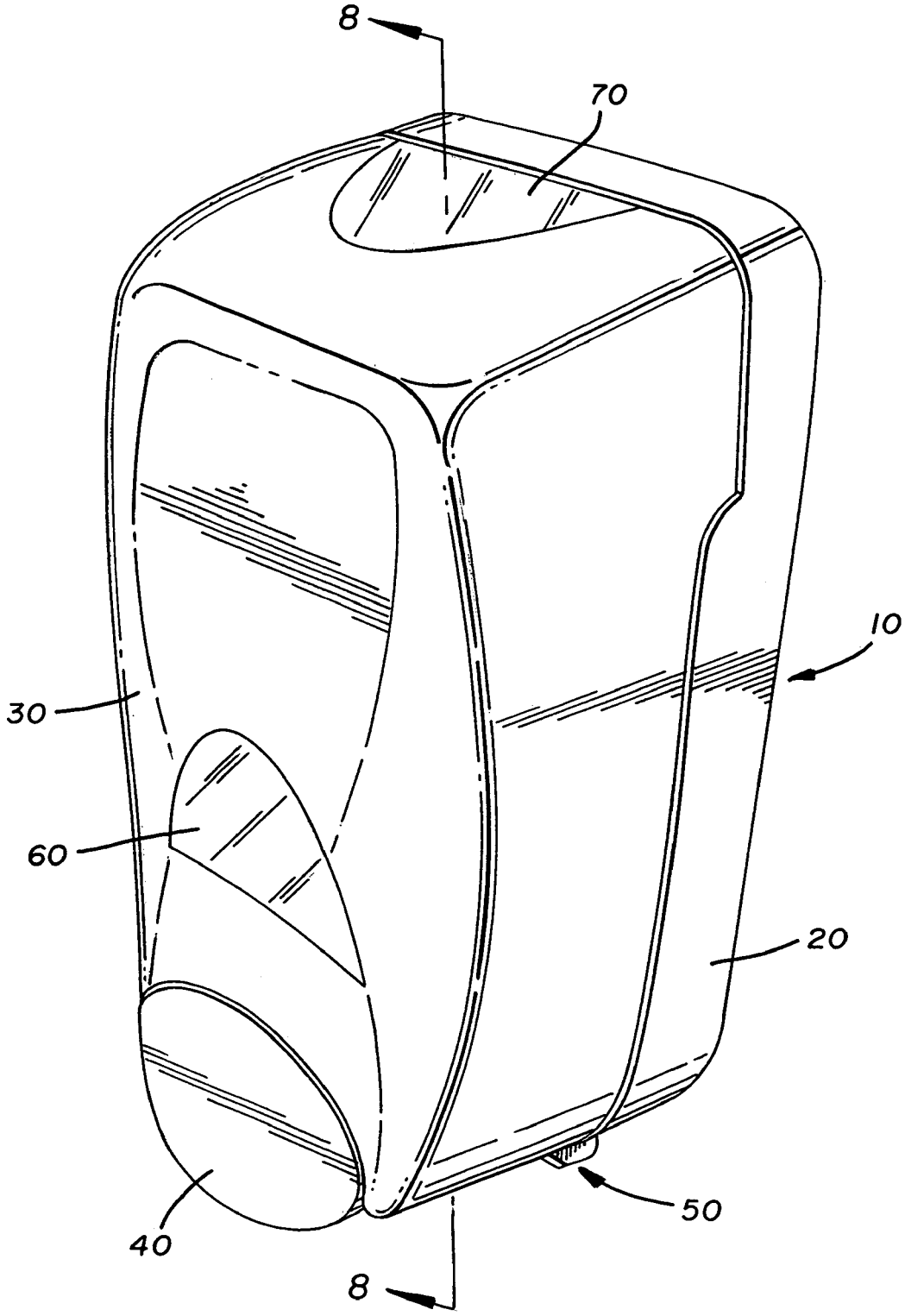
FIG. 1 is a perspective view of the improved dispenser assembly.
Figure 2:
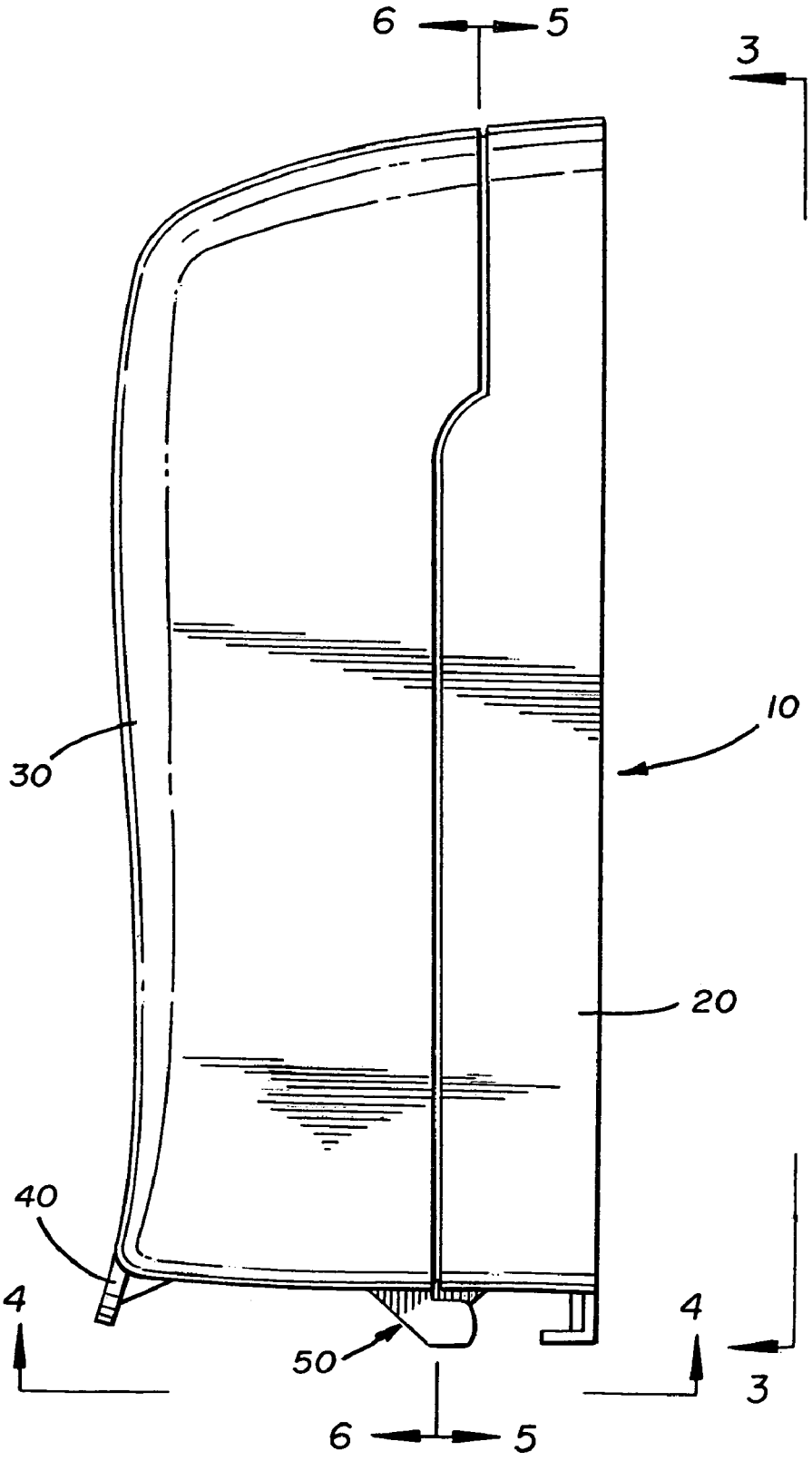
FIG. 2 is a side elevational view thereof.
Figure 8:
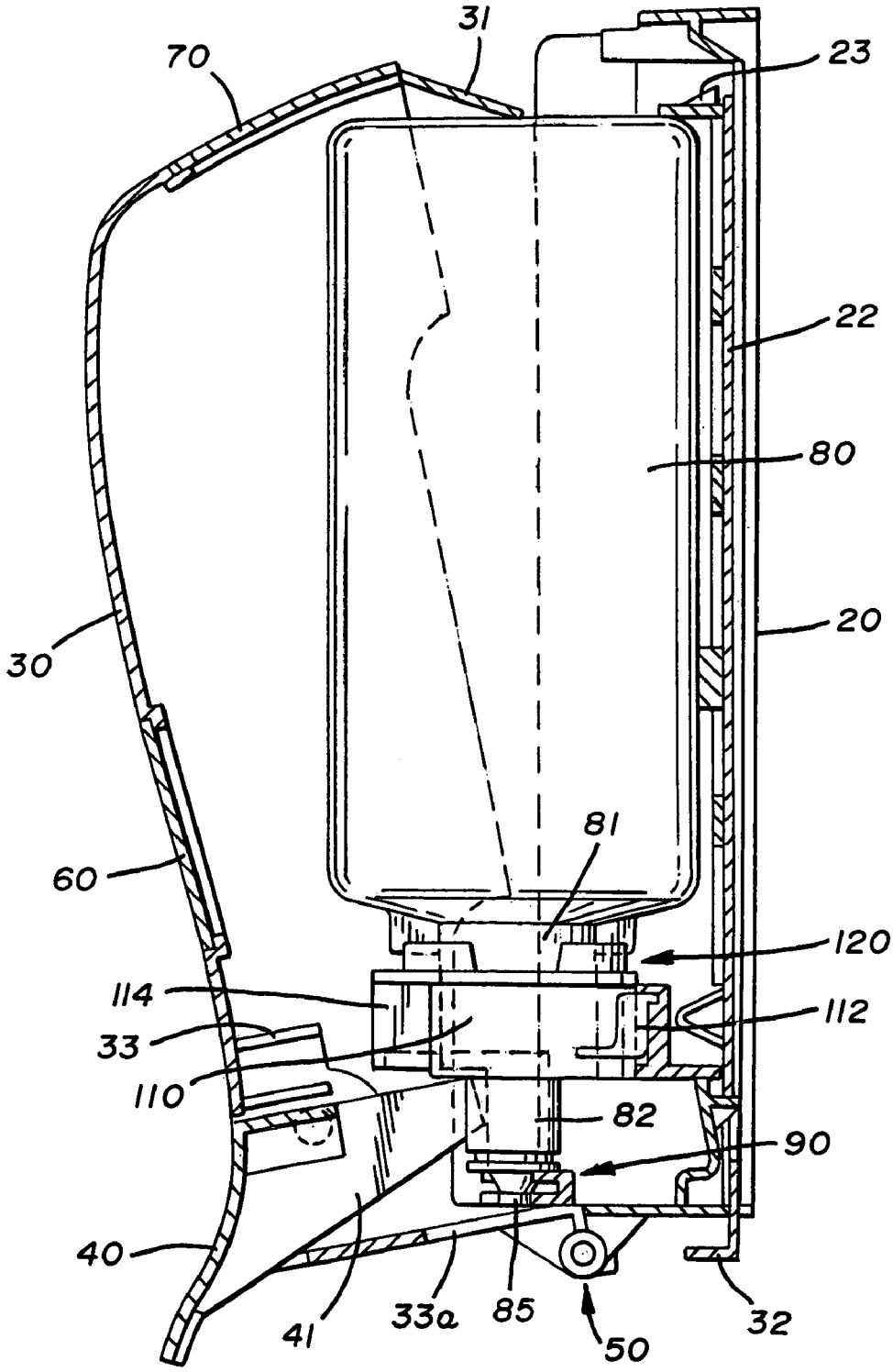
FIG. 8 is sectional elevational view showing the replacement cartridge in place and the cover attached to the back plate.
Figure 9:
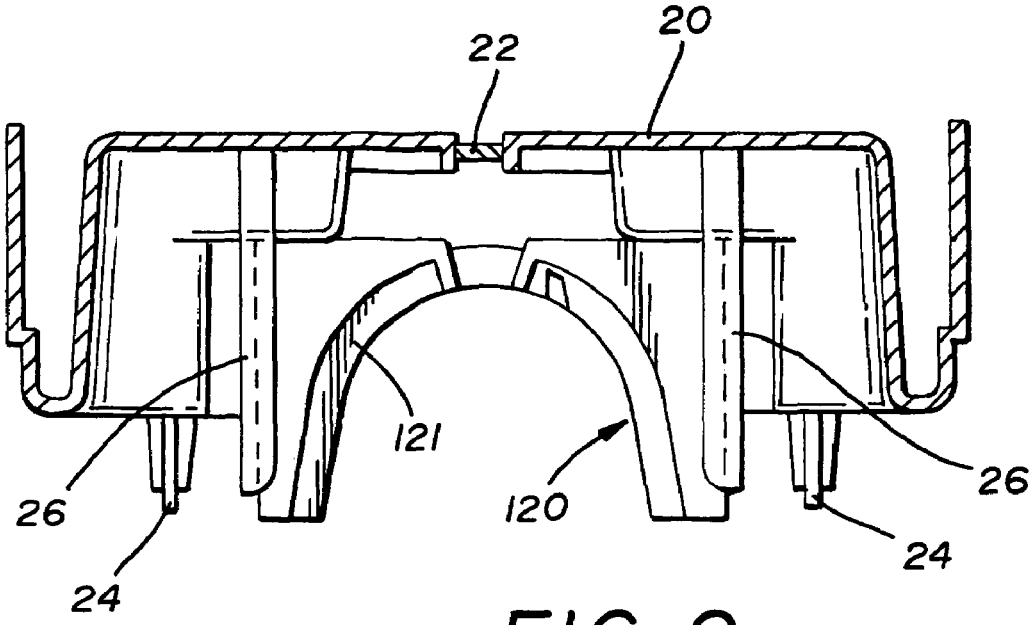
FIG. 9 is a sectional view taken along the line 9—9 of FIG. 5.
Figure 10:
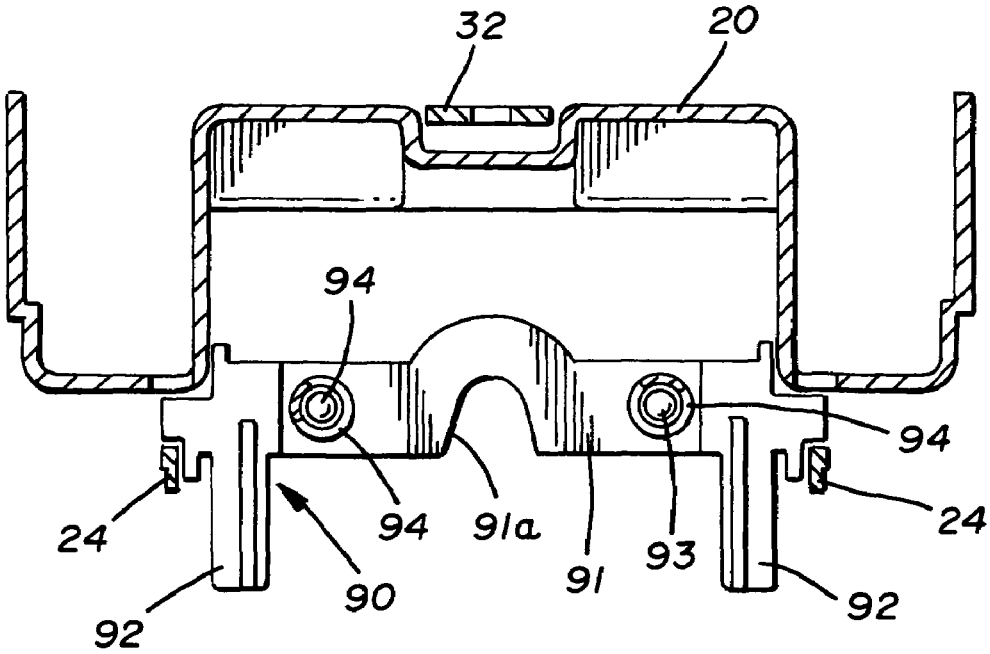
FIG. 10 is a sectional view taken along the line 10—10 of FIG. 5.
Figure 11:
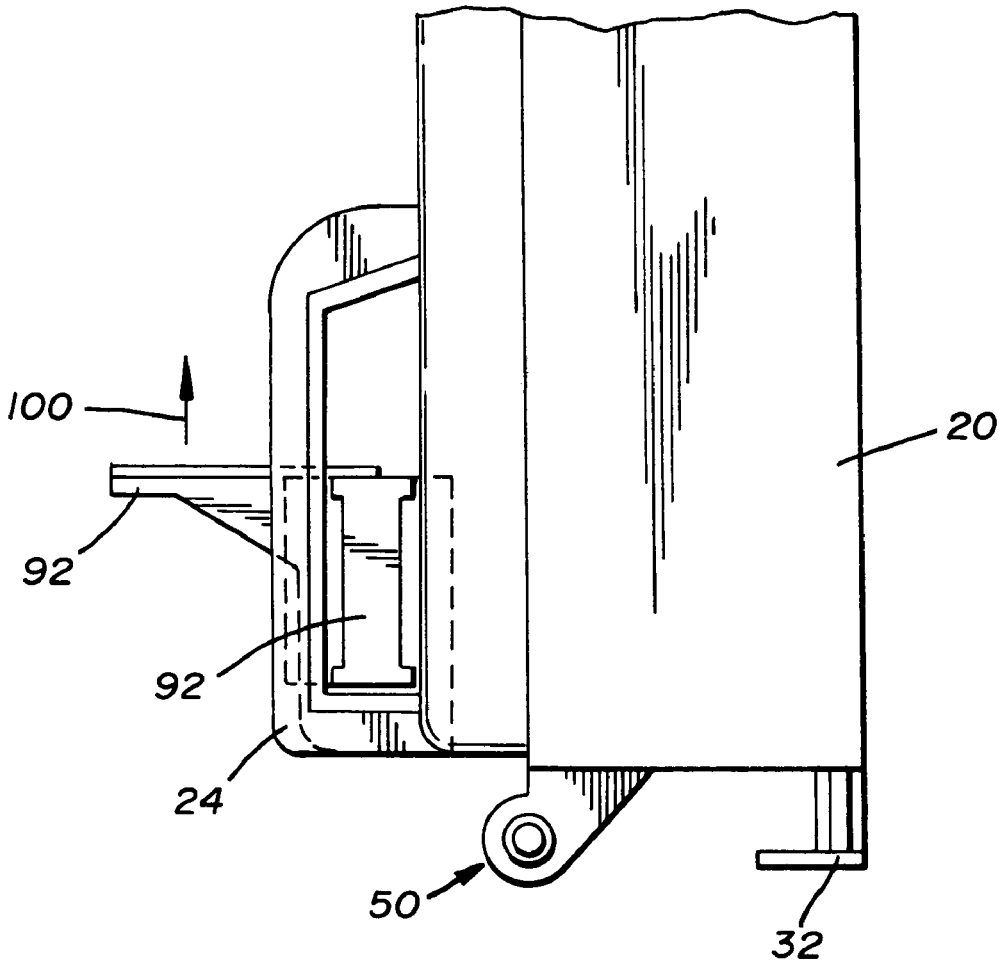
FIG. 11 is a sectional view taken along the line 11—11 of FIG. 5.

Referring first to FIGS. 1 and 2 of the drawings, it will be noted that the dispenser, generally indicated by the numeral 10, includes a back plate or body 20 and a cover 30. These components are hinged together as is generally indicated by the numeral 50 in FIG. 2 so that the cover 30 may be swung away from the back plate 20 for access to the interior as can be seen in FIG. 8, for example. The cover 30 also includes a hinged push bar 40 for engagement by the hand of the user of the dispenser 10 for actuation of the pump contained therein as will be described in greater detail below.

The cover 30 also contains a sight window 60, and a light window 70. Sight windows are commonly used in this art and generally take the form of the small window, such as 60 located near the lower portion of the cover, which presumably enables one to view at least part of the container containing the material from the outside without opening the cover 30. Such windows allow the user to observe the material he or she will receive by actuating the push bar and enable maintenance personnel to ascertain whether the dispenser needs refilling. The present invention contemplates the use of that type of sight window plus a much larger light window 70 at the top of cover 30 with it having been found that greater amounts of light may be admitted to the inside of the container when the cover 30 is in the closed position of FIGS. 1 and 2 thereby enabling enhanced viewing through the window 60 as well as viewing through the window 70. Such an arrangement is particularly advantageous when the container itself is fabricated from clear material.

Figure 3:
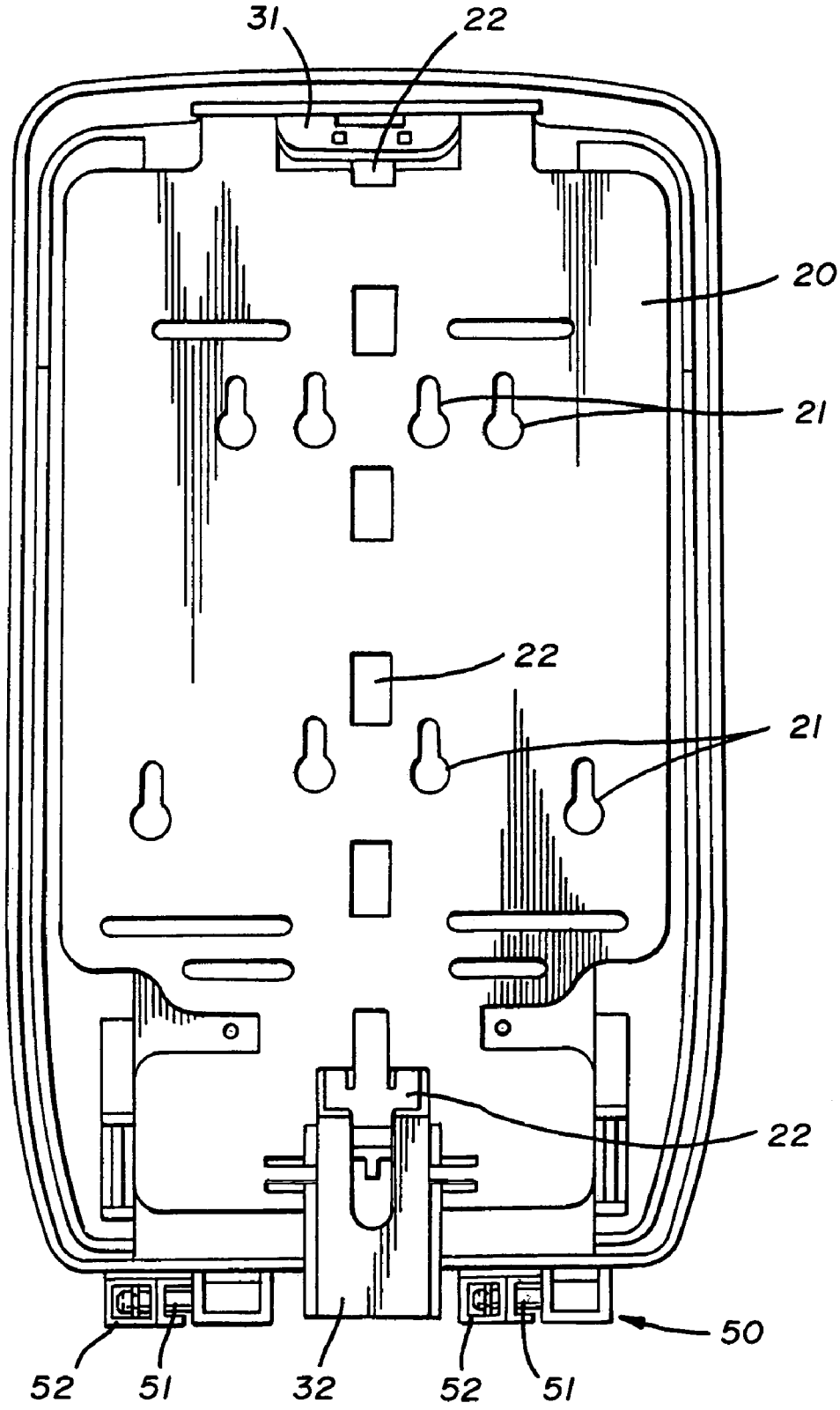
FIG. 3 is a rear elevational view thereof.

Turning then to FIG. 3 of the drawings, it will be seen that the back plate or body 20 has a plurality of through apertures 21, 21 therein with these apertures being utilized to mount the back plate and hence the assembled dispenser 10 on a wall or other vertical surface. In this view also the hinge arrangement 50 can clearly be seen and it will be seen that this arrangement includes hinge pins 51, 51 which are carried by the first or lower end of the back plate 20 and which are received in barrels or pin receiving members 52, 52 which are carried on the first or lower end of cover 30. Thus cover 30 can be easily attached to back plate 20 by snapping hinge pins 51 into pin receiving members 52. It will be understood that different hinge structures could be employed if desired.

Figure 6:
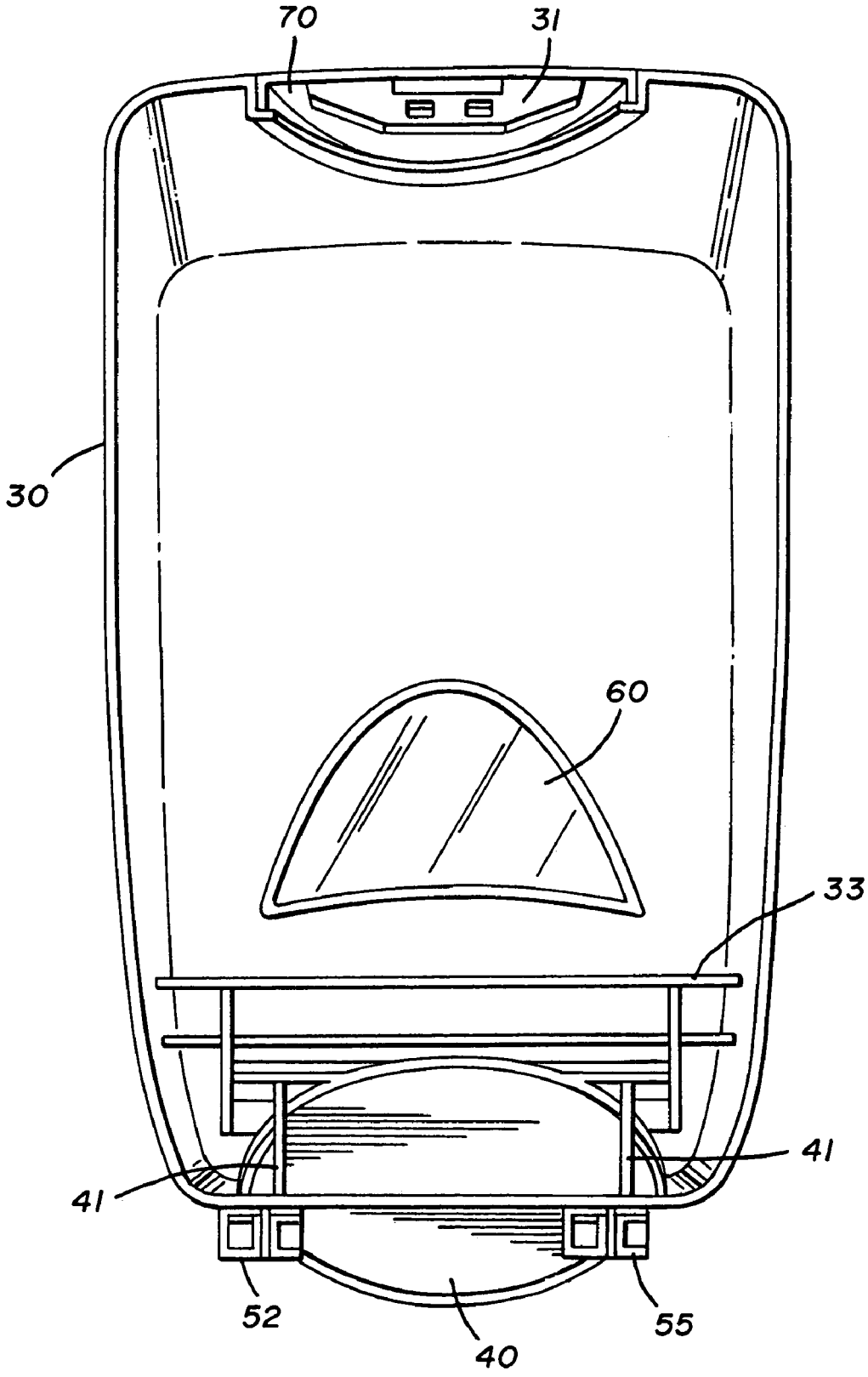
FIG. 6 is an elevational view of the interior of the cover.

Also carried by the back plate or body 20 is an elongate, slidable latch bar 22 which is capable of sliding along the vertical or longitudinal axis of the back plate 20 to engage a latch plate 31 which projects from the top of the cover 30 as can be seen in FIGS. 3, 6 and 8. A key 32 is employed and is inserted through the bottom of cover 30 to activate the latch bar 22 to move it upwardly for disengagement purposes. When the cover 30 is closed the latch plate 31 engages projections 23 on back plate 20 to hold the cover in the closed position. In that regard, the latch plate 31 on the cover 30 is flexibly received on the top or second end of the cover 30 and movement of the latch bar 22 in a vertical direction with respect to FIGS. 3 and 8 will cause its upper end to engage latch plate 31 and flex it to allow the cover 30 to be swung open about the hinge arrangement 50.

Figure 4:
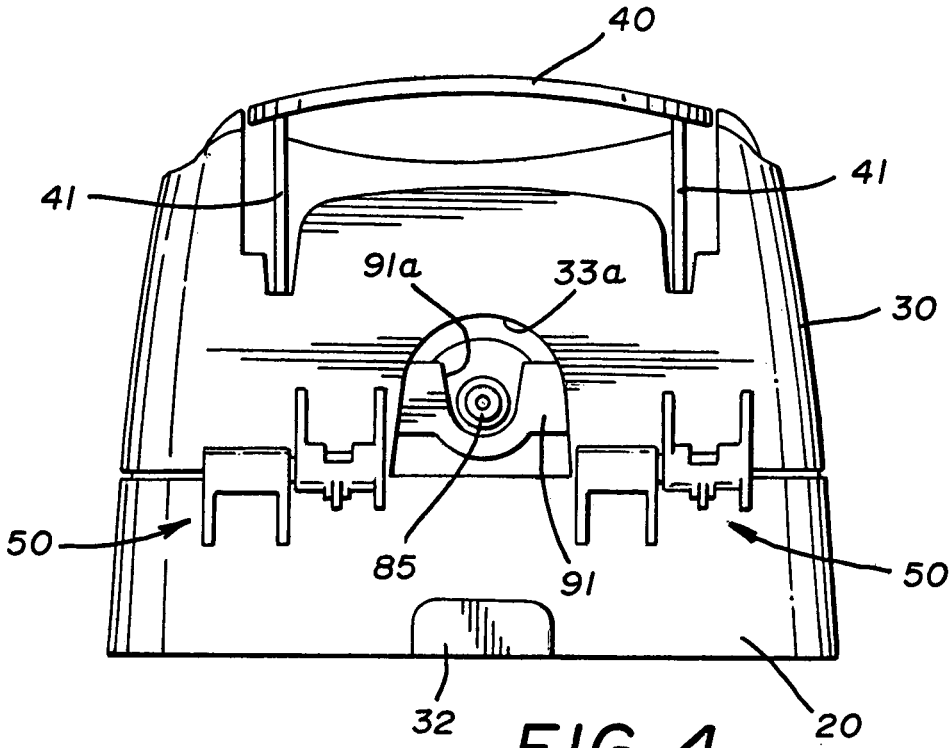
FIG. 4 is a bottom view thereof.
Figure 7A:
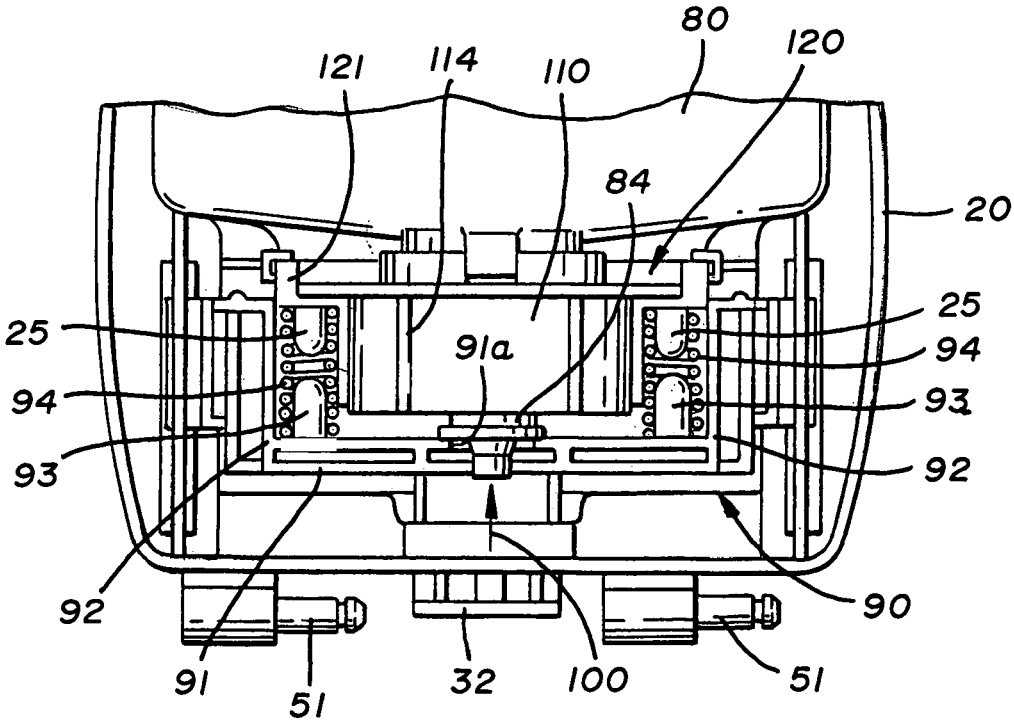
FIG. 7*a* is a partial view similar to FIG. 5 showing the container pump in the collapsed or dispensing position.
Figure 5:
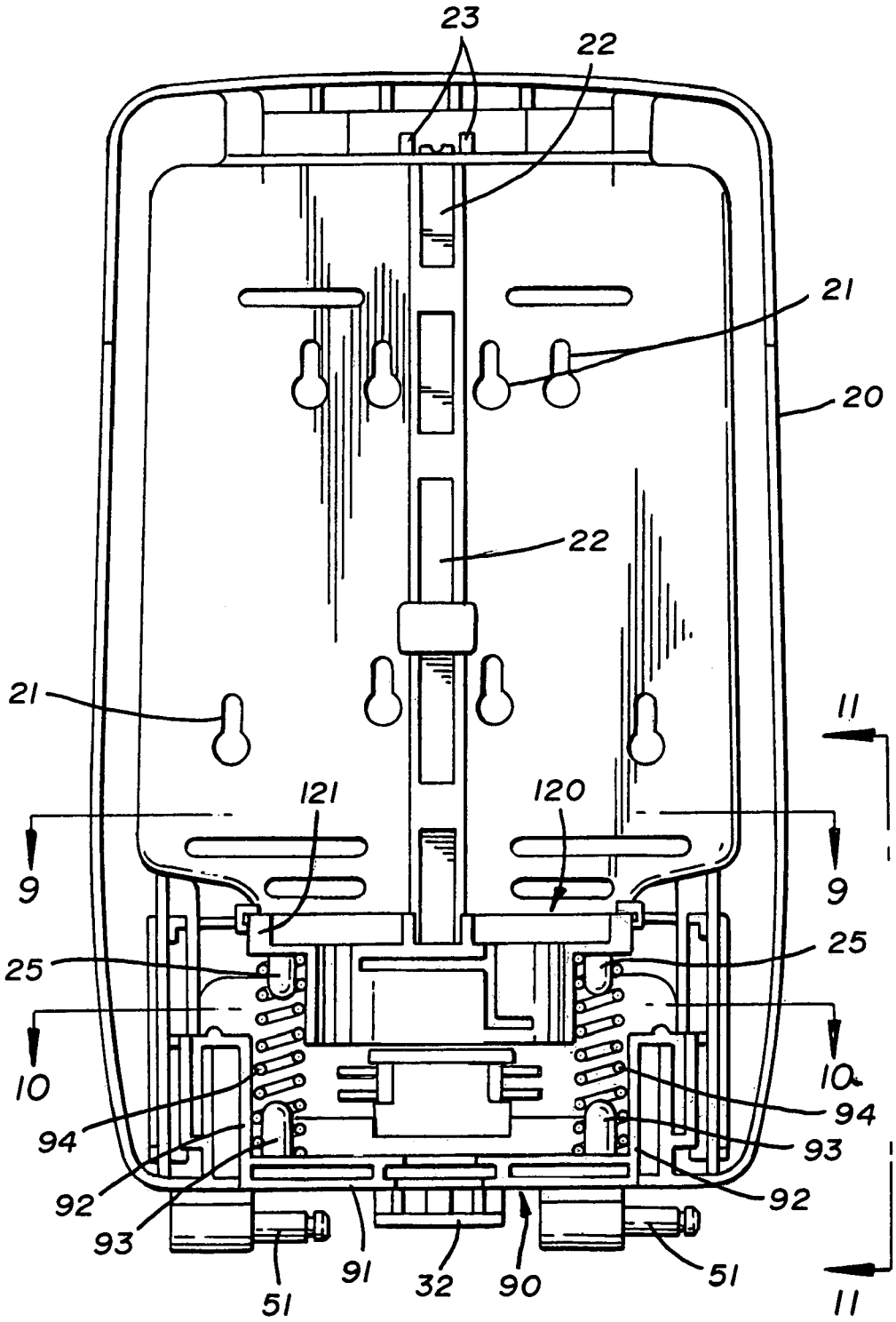
FIG. 5 is an elevational view of the back plate with the cover removed and prior to actuation of the container pump.

Referring then to FIG. 4 of the drawings, it will be seen that the bottom surface 33 of cover 30 has an opening 33*a* and it is intended to be capable of receiving the nozzle of the pump assembly carried by the replacement cartridge as will be described.

Figure 7:
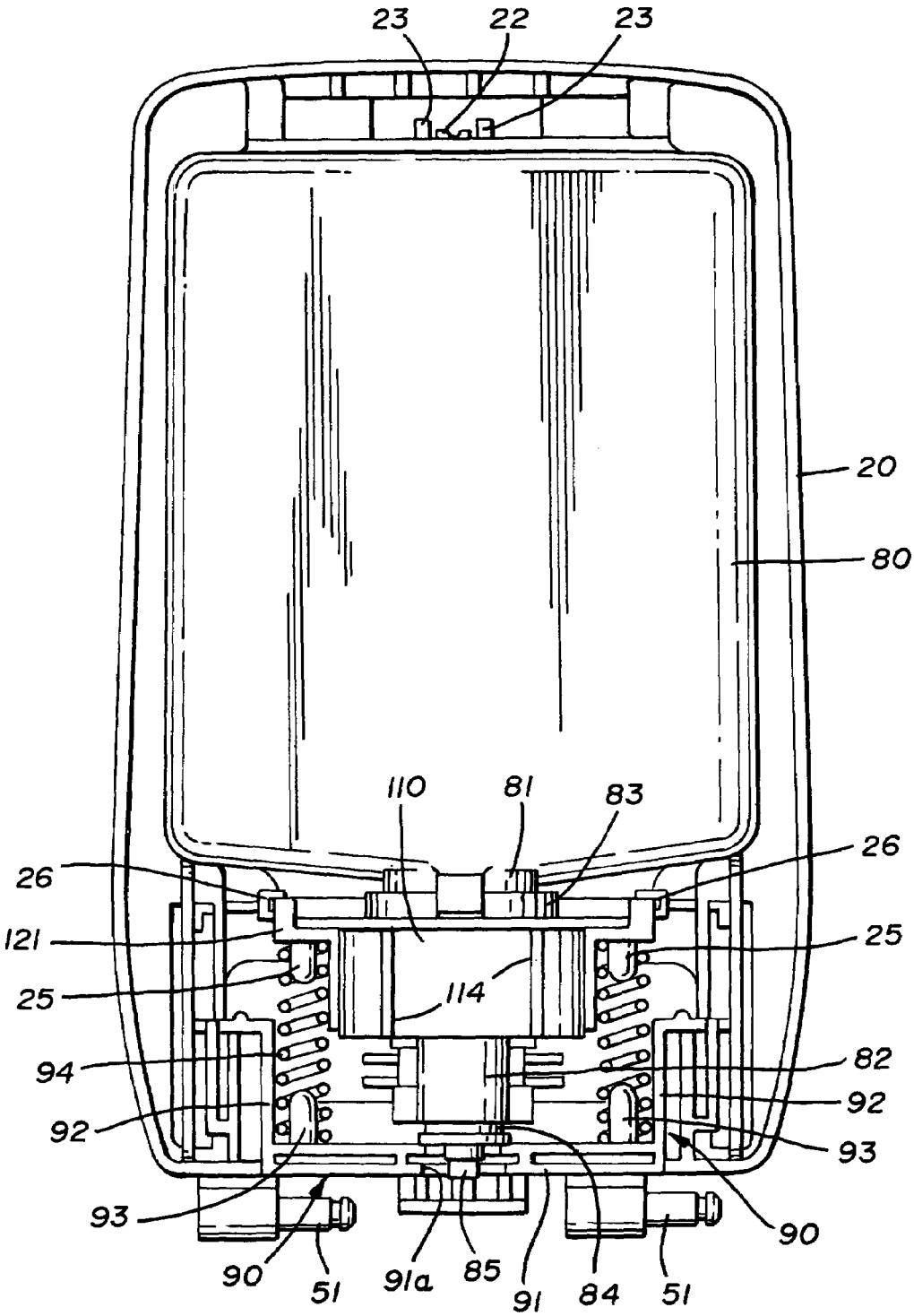
FIG. 7 is a view similar to FIG. 5 showing a replacement container or cartridge in place on the back plate.

In that regard, and referring to FIGS. 7 and 8 of the drawings, the container 80 is illustrated as being a collapsible bottle and has a neck portion 81 which receives a pump 82 which is held in place by a closure member 83 which is generally screwed or otherwise secured to the neck to hold the pump in place. The pump includes a tube (not shown) which is in fluid communication with the interior of the container 80, a collapsible pumping member 84 and a nozzle 85. Material is dispensed through nozzle 85 by collapsing the pumping member 84.

FIG. 6 is a view of the inner surface of the cover 30 showing the latch plate 31, sight window 60 and light window 70, push bar 40 and at least one transverse rib 33 on the inner surface of cover 30 which assists in retaining the container or refill cartridge within the dispenser 10 when the cover is closed as will also be described below.

This view also illustrates an additional feature of push bar 40 which has opposed extending legs 41, 41 which, upon inward movement of push bar 40, assist in actuating the pump as will be more fully described below.

FIG. 7 illustrates the refill container or cartridge 80 inserted into the back plate or body 20 with its nozzle 85 projecting through the aperture 33*a* in the bottom of the cover 30. As mentioned, the container carries a pump 82 which is of the collapsible type so that collapse of the retractable portion thereof will discharge a predetermined amount of the container contents through nozzle 85.

The container or refill cartridge 80 generally includes a body 81 and it is contemplated that this would be of the "rigid" type commonly used in the industry wherein, while denominated as rigid, the bottle actually will collapse as the material contained therein is drawn out through the nozzle 85 by activation of the pump 82. These bottles are generally provided with fold lines of various designs (not shown) and collapse much as a flexible bag collapses as the material is drawn out and, in that regard, of course, the sight window 60 and light window 70 are advantageous in that they enable one to readily observe the condition of the container without opening the cover 30.

Actuator 90, as seen in FIGS. 5, 7, 7*a* and 12, is a generally U-shaped member having a cross bar 91 and upwardly projecting legs 92, 92 which are slidably received on rails 24 on back plate or body 20. An aperture 91*a* is provided in cross bar 91 for receipt of pump nozzle 85 and it will be seen by comparing FIGS. 7 and 7*a* that when actuator 90 is slid upwardly on rails 24, the pumping member 84 will be collapsed to dispense material from container 80. Thus, it can be seen that as actuator 90 moves vertically in response to movement of the push bar 40 in the direction of the arrow 100, that legs 41 will engage actuator 90 and the pumping member 84 of pump 82 will be collapsed and activated as the cross bar 91 engages it in order to draw material from the container or cartridge 80 through the nozzle 85. The extending legs 41 of push bar 40 cause this by engaging beneath cross bar 91 as the push bar 40 pivots inwardly.

It will be noted that cross bar 91 has a pair of upwardly projecting, opposed stub shafts 93 and that a pair of facing stub shafts 25 are carried by bracket 121 of the container receiving means 120 which is received on back plate 20. These serve as seats for coil springs 94, 94 which serve to urge actuator 90 and push bar 40 back to the idle position of FIG. 1 after the dispensing operation has taken place and the push bar 40 has been released.

FIGS. 7, 7*a*, 8 and 12 also illustrate the means for retaining the cartridge or the refill container 80 within the dispenser. To that end, a collar 110 is secured to the closure member on the neck 81 of the container 80. It is understood that the container would be supplied to the user in that condition with the collar 110 in place. This collar has on its outer surface at least one horizontal rib 111 and at least one vertical rib 112.

Figure 12:
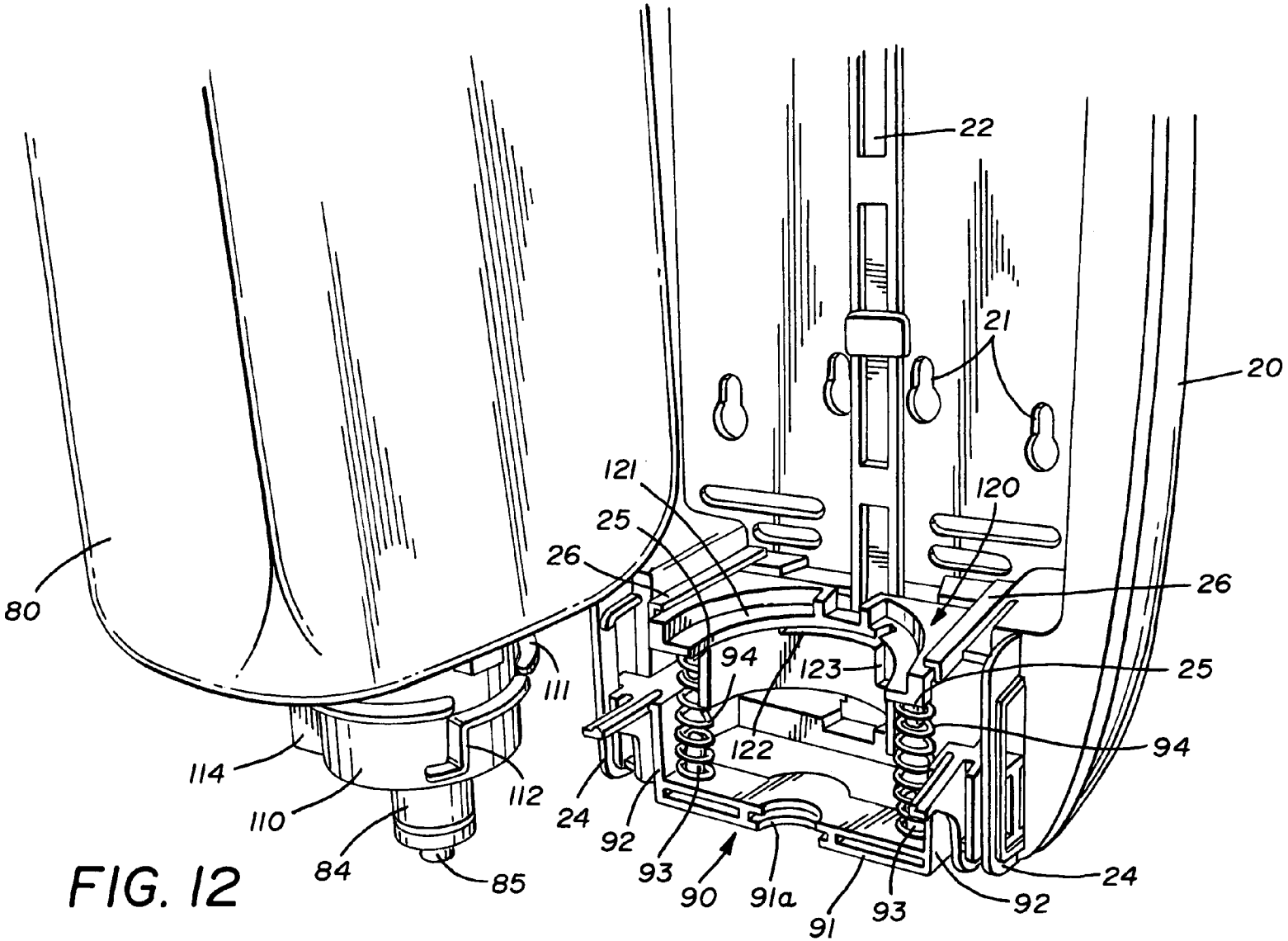
FIG. 12 is an enlarged view showing the keying arrangement between the container and the dispenser.

Container receiving means are carried by the back plate or body 20 and are generally indicated by the numeral 120 as can be seen in FIG. 12. These means consist of a horseshoe-shaped bracket 121 which is slidably snapped into channels 26 on the back plate 20 and which includes complemental recesses or grooves 122 and 123 which receive the collar 110 and the ribs 111 and 112 thereof. This makes is possible to firmly engage the collar 110 and, thus, to firmly engage the container 80 within the dispenser 10.

When the cover 30 is closed, the ribs 33 also will engage legs 114 of this collar to assist in retaining the cartridge or refill container 80 in place. This is important in that when containers such as 80 are collapsed, there is often a tendency for them to twist or turn somewhat and the ribs 33 will assist in resisting that to the extent that the pump 82 will be held in its operative position so that upon actuation of the push bar 40 and the actuator means 90 the dispenser will function as designed.

In use or operation of the improved dispenser assembly, it will first be assumed that a container 80 will be provided to the user with a collar 110 already in place thereon. Assuming the cover 30 to be in the open position, it is simply necessary to insert the container 80 into the back plate and locate the collar 110 in the container receiving means 120 with the nozzle 85 and the pump 82 projecting downwardly and the nozzle 85 projecting through the aperture 33*a* in the bottom of the cover 30 and aperture 91*a* in the cross bar 91 of actuator 90. The cover 30 can then be closed with the latch plate 31 engaging the projections 23 on the back plate or body 20 to lock the cover in the closed position of FIG. 1. Actuation of the push bar 40 at that point will cause the legs 41 of the push bar 40 to engage actuator 90 and move it upwardly against the force of springs 94 bringing the cross bar 91 and actuator 90 into engagement with the bracket 121 to activate and collapse pumping member 84 and dispense material through nozzle 85.

It will be seen then that the present invention provides several advantages over the prior art.

First, the addition of a light window 70, adjacent the top or second end of the cover 30, permits a much greater quantity of ambient light to be transmitted into the interior of the dispenser. This makes it easier to observe through the sight window 50 to ascertain whether or not the refill container 80 is empty or close to empty and requires replacement. It also enhances the viewing capabilities of the interior in the closed position so that one can ascertain the nature of the material contained in container 80.

The utilization of the container receiving means 120 and the collar 110 and their mating characteristics enhance the stability and location of container 80 and ensure that the pump 84 is properly located at all times. This feature also has an additional advantage, in that dispensers of this type commonly are labeled on the exterior of the cover 30 with the identification of the material contained therein, e.g., soap, lotion, etc. The use of the collar 80 ensures that the proper material is utilized for refilling the dispenser so that the user gets what he or she intends to get based on the labeling on the exterior of the cover 30.

It should be noted that the precise configuration of the ribs 111 and 112 and the grooves 122 and 123 could be varied depending on the contents of the container 80 so as to insure that only the proper refill is utilized in a given dispenser. That is, different rib and groove geometry than that illustrated can be employed to insure that only the proper refill for any given dispenser is employed.

While a full and complete description of the invention has been set forth in accordance with the dictates of the Patent Statutes, it should be understood that modifications can be resorted to without departing from the spirit hereof or the scope of the appended claims.

What is claimed is:

1. A dispenser assembly for dispensing fluid material from a material containing container which includes an attached pump comprising:

a) an elongate back plate having first and second ends;

b) an elongate cover having first and second ends, said first end of said cover being hingedly attached to said first end of said back plate for movement into and out of covering relationship with said back plate;

c) container receiving means carried by said back plate for receiving and supporting the container;

d) a push bar carried by said cover and movable toward the pump when said cover is in covering relationship with said back plate;

e) a pump actuator slidably carried by said back plate;

f) at least one transparent window in said cover; and g) retention means carried by said cover for engaging the container when said cover is in covering relationship with said back plate and the container is received in said receiving means.

2. The dispenser assembly of claim 1 further characterized by the presence of latch means carried by said second end of said ends of said cover and said back plate for releasable engagement when said cover is moved into covering relationship with said back plate.

3. The dispenser assembly of claim 1 further characterized by the presence of first and second transparent windows in said cover; said first transparent window being located adjacent said first end of said cover and said second transparent window being disposed adjacent said second end of said cover.

4. The dispenser assembly of claim 1 wherein the material receiving container has a neck, a closure member received on the neck and a security collar attached thereto; said container receiving means include a container neck receiving bracket; said bracket being contoured complementally with the security collar.

5. The dispenser assembly of claim 4 wherein the security collar has keying means on its periphery; said container receiving means including a bracket releasably received on said back plate has complemental keying means thereon for mating engagement with said keying means.

6. The dispenser assembly of claim 5 wherein said keying means of the security collar and said bracket comprise mating grooves and slots.

7. The dispenser assembly of claim 1 wherein said cover has inner and outer surfaces; and said retention means include at least one transversely extending retaining rib projecting from said inner surface.

8. The dispenser assembly of claim 1 wherein means for engaging said pump actuator are carried by the push bar.

9. The dispenser assembly of claim 8 wherein said pump actuator includes an actuator plate slidably carried by said back plate for movement toward and away from the pump in response to movement of the push bar.

* * * * *